US009794674B1

(12) United States Patent
Lee

(10) Patent No.: US 9,794,674 B1
(45) Date of Patent: Oct. 17, 2017

(54) EAR-MOUNTED SOUND-OUTPUT DEVICE WITH POSITION-ADJUSTABLE SOUND-OUTPUT UNIT

(71) Applicant: Seung Chul Lee, Daegu (KR)

(72) Inventor: Seung Chul Lee, Daegu (KR)

( * ) Notice: Subject to any disclaimer, the term of this patent is extended or adjusted under 35 U.S.C. 154(b) by 0 days.

(21) Appl. No.: 15/144,409

(22) Filed: May 2, 2016

(51) Int. Cl.
*H04R 1/10* (2006.01)

(52) U.S. Cl.
CPC ..... *H04R 1/105* (2013.01)

(58) Field of Classification Search
CPC ..... H04R 1/105; H04R 1/1033
USPC ..... 379/430; 381/74, 373, 379, 380, 381, 381/384, 385, 104, 312, 370, 374; 455/557; 2/209.13; 248/58; 343/897
See application file for complete search history.

(56) References Cited

U.S. PATENT DOCUMENTS 5,729,615 A * 3/1998 Yang ..... H04R 1/1066 181/129
5,927,659 A * 7/1999 Yang ..... H04R 1/1033 181/129
8,761,431 B1 * 6/2014 Jackson ..... H04R 5/0335 381/367
9,736,565 B2 * 8/2017 Lee ..... H04R 1/1033
2002/0094094 A1 * 7/2002 Shin ..... H04R 1/1066 381/104
2005/0271228 A1 * 12/2005 Lai ..... H04R 25/554 381/312
2007/0104345 A1 * 5/2007 Yang ..... H04R 1/1066 381/381
2008/0013773 A1 * 1/2008 Yang ..... H04R 1/2826 381/379
2008/0159579 A1 * 7/2008 Park ..... H04R 1/1033 381/370
2008/0253554 A1 * 10/2008 Chen ..... H04M 1/05 379/430
2008/0253603 A1 * 10/2008 Huang ..... H04R 1/1091 381/374
2011/0170703 A1 * 7/2011 Palma ..... H04R 1/1041 381/74
2012/0163616 A1 * 6/2012 Birch ..... H04M 1/6058 381/74
2013/0022226 A1 * 1/2013 Anderson ..... H04R 1/10 381/380
2013/0251172 A1 * 9/2013 Mosseri ..... H04R 1/1083 381/74
2014/0047616 A1 * 2/2014 Lee ..... A42B 1/245 2/209.13

(Continued)

*Primary Examiner* — Gerald Gauthier
(74) *Attorney, Agent, or Firm* — Paratus Law Group, PLLC

(57) ABSTRACT

The present disclosure provides an ear-mounted sound-output device with a position-adjustable sound-output unit, wherein the ear-mounted sound-output device comprises: a 'C' shaped body; a first connection cable; a sound-output unit coupled to one end of the first connection cable, wherein the body is stretched via application of an external force thereto, to allow the outer ear of the user to be inserted between both ends of the body, and the body is secured around the outer ear with the body being restored via withdrawal of the external force, wherein the first connection cable is configured to move through the accommodation space and the hollow portion depending on a usage environment of the device.

16 Claims, 15 Drawing Sheets

(56) References Cited

U.S. PATENT DOCUMENTS

| | | | | |
|---|---|---|---|---|
| 2014/0119590 | A1* | 5/2014 | Burgett | H04R 1/1033<br>381/384 |
| 2015/0148100 | A1* | 5/2015 | Malenotti | H04M 1/0254<br>455/557 |
| 2015/0257315 | A1* | 9/2015 | Wagner | H01B 3/18<br>343/897 |
| 2016/0182995 | A1* | 6/2016 | Kamada | H04R 1/1075<br>381/373 |
| 2016/0249124 | A1* | 8/2016 | Drinkwater | H04R 1/105 |

* cited by examiner

EAR-MOUNTED SOUND-OUTPUT DEVICE WITH POSITION-ADJUSTABLE SOUND-OUTPUT UNIT

BACKGROUND

Field of the Present Disclosure

The present disclosure relates to an ear-mounted sound-output device with a position-adjustable sound-output unit depending on a usage environment of the device.

Discussion of the Related Art

The ear-mounted sound-output device, for example, an ear-phone device outputs a sound to an ear of the user. The ear-mounted sound-output device may be connected via a wire or wirelessly to, for example, a MP3 player, mobile phone, PC, notebook, tablet, etc.

The conventional ear-mounted sound-output device has a sound-output unit, for example, a kernel type-speaker, to be inserted into an ear hole of the user in use. Thus, in the use thereof, the user may only listen to the sound from the sound-output unit. However, most of the user may have a situation where the user has to perform multiple works including reading, exercises, or business at the same time as hearing the music. Thus, in such a situation, using the conventional ear-mounted sound-output device with the sound-output unit to be inserted into the ear hole, the user may rarely hear other sounds than the sound from the ear-mounted sound-output device. This may cause a dangerous event. For example, this may be applied to a situation when the user does outdoor activities such as jogging, bicycling, etc. Further, when the sound-output unit is inserted into the ear hole for a long time with continuously hearing the sound therefrom, a tympanic membrane of the user may be negatively affected.

A prior art document related to the present disclosure may be as follows: Korean Patent application number 10-2004-0090296.

SUMMARY

From considerations of the above situations, the present disclosure provides an ear-mounted sound-output device with a position-adjustable sound-output unit configured to move to between an inner hole of an ear of a user and one end of the body depending on a usage environment of the device, whereby the user may safely or reliably perform multiple tasks with hearing the music when the user needs to hear sounds related to the multiple tasks via a retracted state of the sound-output unit, or, otherwise, the user may only listen to the music with blocking surrounding noises or sounds via an outwardly extended state of the sound-output unit.

In one aspect, the present disclosure provides an ear-mounted sound-output device with a position-adjustable sound-output unit, wherein the ear-mounted sound-output device comprises: a 'C' shaped body having an inner lengthwise hollow portion formed therein; a first connection cable configured to extend through the inner lengthwise hollow portion of the body; a sound-output unit coupled to one end of the first connection cable, wherein the sound-output unit is configured to move to between an inner hole of an ear of a user and one end of the body depending on a usage environment of the device; a first stopper coupled to one end of the body and having an inner accommodation space formed therein to accommodate the sound-output unit, and the accommodation space being cable-communicating with the hollow portion of the body, wherein the body is stretched via application of an external force thereto, to allow the outer ear of the user to be inserted between both ends of the body, and the body is secured around the outer ear with the body being restored via withdrawal of the external force, wherein the first connection cable is configured to move through the accommodation space and the hollow portion depending on a usage environment of the device.

In one embodiment, the device further comprises a second stopper coupled to the other end of the body, the second stopper having a through-hole formed therein, the through-hole being cable-communicating with the hollow portion of the body, wherein a cooperation of the first and second stoppers at both ends of the body respectively allow the body to be secured around the outer ear of the user, wherein, depending on the usage environment of the device, the first connection cable is configured to move through and along the hollow portion of the body and the through-hole of the second stopper.

In one embodiment, the device further comprises a cable support coupled to the first connection cable in a longitudinal manner, the cable support being configured to move together with the movement of the first connection cable to maintain a shape of the first connection cable resulting from the movement thereof.

In one embodiment, the body has a body cut portion partially cut from the body to partially expose the first connection cable, wherein the user moves the first connection cable through the body cut portion such that the sound-output unit moves from one end of the body into the ear hole of the user.

In one embodiment, the device further comprises a cable moving member coupled through the body cut portion to the first connection cable, wherein a movement of the cable moving member moves the first connection cable such that the sound-output unit moves from one end of the body into the ear hole of the user.

In one embodiment, the device further comprises a first cable moving member, wherein the first cable moving member includes a first connector having one end coupled through the body cut portion to the first connection cable, and a first rotation member coupled to the other end of the first connector, wherein the first rotation member has a circular shape and has a teeth shaped circumference, wherein when the first rotation member is rotated, the teeth shaped circumference thereof contacts and moves the first connection cable, such that the sound-output unit moves from one end of the body into the ear hole of the user.

In one embodiment, the first connection cable has teeth-engaged grooves formed in a lengthwise direction in an outer face portion thereof to be meshed with the teeth of the teeth shaped circumference of the first rotation member, wherein when the first rotation member is rotated, the teeth-engaged grooves are meshed with the teeth of the teeth shaped circumference of the first rotation member and are moved in a lengthwise direction to move the first connection cable, such that the sound-output unit moves from one end of the body into the ear hole of the user.

In one embodiment, wherein the device further comprises a first sound-output unit support, wherein the first sound-output unit support includes extendable or retractable multi-steps pipes, and wherein the first sound-output unit support has one end coupled to the first stopper, and the other end coupled to the sound-output unit, wherein the first sound-output unit support has a longitudinal through hole being cable-communicating with a through-hole of the first stopper cable-communicating with the hollow portion of the body, wherein the first sound-output unit support extends outwardly such that the first connection cable moves through the longitudinal through hole of the support, the through-hole of the first stopper and the hollow portion of the body, such that the sound-output unit is inserted into the ear hole.

In one embodiment, the device further comprises a first sound-output unit support including extendable or retractable multi-steps pipes, wherein the first sound-output unit support further has a body-side flexible member coupled through the first stopper to one end of the multi-steps pipes, wherein when a free end of the body-side flexible member moves toward the first stopper, the first sound-output unit support is extended outwardly such that a free end of the first sound-output unit support contacts the ear hole of the user.

In one embodiment, the device further comprises a support moving member, wherein the support moving member includes a first connector having one end coupled to one end of the body, and a first rotation member coupled to the other end of the first connector, wherein the first rotation member has a circular shape and has a teeth shaped circumference, wherein when the first rotation member is rotated, the teeth of the teeth shaped circumference contact the body-side flexible member of the first sound-output unit support and move the body-side flexible member so as to extend or retract the multi-steps pipe of the first sound-output unit support, such that the free end of the first sound-output unit support is inserted into the ear hole of the user or is removed from the ear hole.

In one embodiment, the device further comprises a wrinkled length-adjustable tube has one end coupled to the first stopper, wherein the wrinkled length-adjustable tube is extended outwardly such that the free end thereof contacts the ear hole of the user.

In one embodiment, the device further comprises an elastic attachment attached to one side of the body, wherein the elastic attachment is configured to be deformed via application of an external force and be restored due to an elasticity force itself via withdrawal of the external force, wherein via application of an external force, the body is stretched to allow the outer ear of the user to be inserted between both ends of the body, and via withdrawal of the external force, the elastic attachment is restored due to an elasticity force itself to allow the body to be secured around the outer ear of the user.

In one embodiment, the device further comprises a first loop-shaped deformation member configured to be deformed via application of an external force and be restored due to its elasticity via withdrawal of the force, wherein the first loop-shaped deformation member is coupled to an inner side face of the C shaped body, wherein when the force is applied to the first loop-shaped deformation member at the lateral convex portions thereof, the first loop-shaped deformation member is deformed to allow the body to be stretched.

In one embodiment, the device further comprises a body support coupled to and along a lengthwise portion of an outer or inner face of the body, wherein the body support is deformed via application of a first external force to maintain the deformed body together therewith as they are deformed, wherein via application of the first external force, the body is stretched, the body support maintains the stretched body in a shape thereof, to allow the outer ear of the user to be inserted between both ends of the body, wherein via application of a second external force opposite the first external force, the body support is restored to its original shape to maintain the restored body together therewith at they are restored, to allow the body to be secured around the outer ear of the user.

In one aspect, the present disclosure provides an ear-mounted sound-output device with a position-adjustable sound-output unit, wherein the ear-mounted sound-output device comprises: a 'C' shaped body having an inner lengthwise hollow portion formed therein; a first connection cable configured to extend through the inner lengthwise hollow portion of the body; a sound-output unit coupled to one end of the first connection cable, wherein the sound-output unit is configured to move to between an inner hole of an ear of a user and one end of the body depending on a usage environment of the device; an audio signal generation module coupled to the other end of the body, wherein the body is stretched via application of an external force thereto, to allow the outer ear of the user to be inserted between both ends of the body, and the body is secured around the outer ear with the body being restored via withdrawal of the external force, wherein the first connection cable has the other end coupled to the audio signal generation module, wherein the first connection cable is configured to move through the hollow portion depending on a usage environment of the device.

In one embodiment, the audio signal generation module has an elongate protrusion coupled via a hinge to the other end of the body, wherein via application of an external force, the body rotates using the hinge, wherein the device further comprises a loop-shaped deformation member configured to be deformed via application of an external force and be restored due to the elasticity thereof via withdrawal of the external force, wherein the loop-shaped deformation member is coupled, at one side thereof, to the other end of the body, and, at the other side thereof, to one side face of the audio signal generation module, wherein when the external force is applied to both convex side portions of the deformation member, the loop-shaped deformation member is deformed to enable the body to rotate using the hinge, such that the deformation of the loop-shaped deformation member increases a space between the free end of the body and the audio signal generation module.

The ear-mounted sound-output device in accordance with the present disclosure may have following effects:

First, the present sound-output unit may operate in a first mode where the sound-output unit is not inserted into the ear hole, but is secured to an outer face of the ear, whereby the user may hear both the sound from the ear-mounted sound-output device and the ambient sounds around the user, thereby to prevent the dangerous situation which, otherwise, may happen to the user. Further, the present sound-output unit may operate in a second mode where the sound-output unit is inserted into the ear hole, whereby the user may only hear the sound from the sound-output unit if desired by the user.

Second, the ear-mounted sound-output device has both opposing stoppers at both ends of the body respectively, which may be engaged with the outer face of the ear at a spaced distance, to allow the ear-mounted sound-output device to be secured around the outer ear. Thus, when the user does outdoor activities with wearing the ear-mounted sound-output device, the present ear-mounted sound-output device may be prevented from being removed from the ear compared to the conventional ear-mounted sound-output device. Further, via the simple stretching or restoring operation of the body, the ear-mounted sound-output device may be disengaged or engaged from or with the ear.

BRIEF DESCRIPTION OF THE DRAWINGS

A brief description of each drawing is provided to more fully understand the drawings, which is incorporated in the detailed description of the disclosure.

DETAILED DESCRIPTIONS

Figure 1:
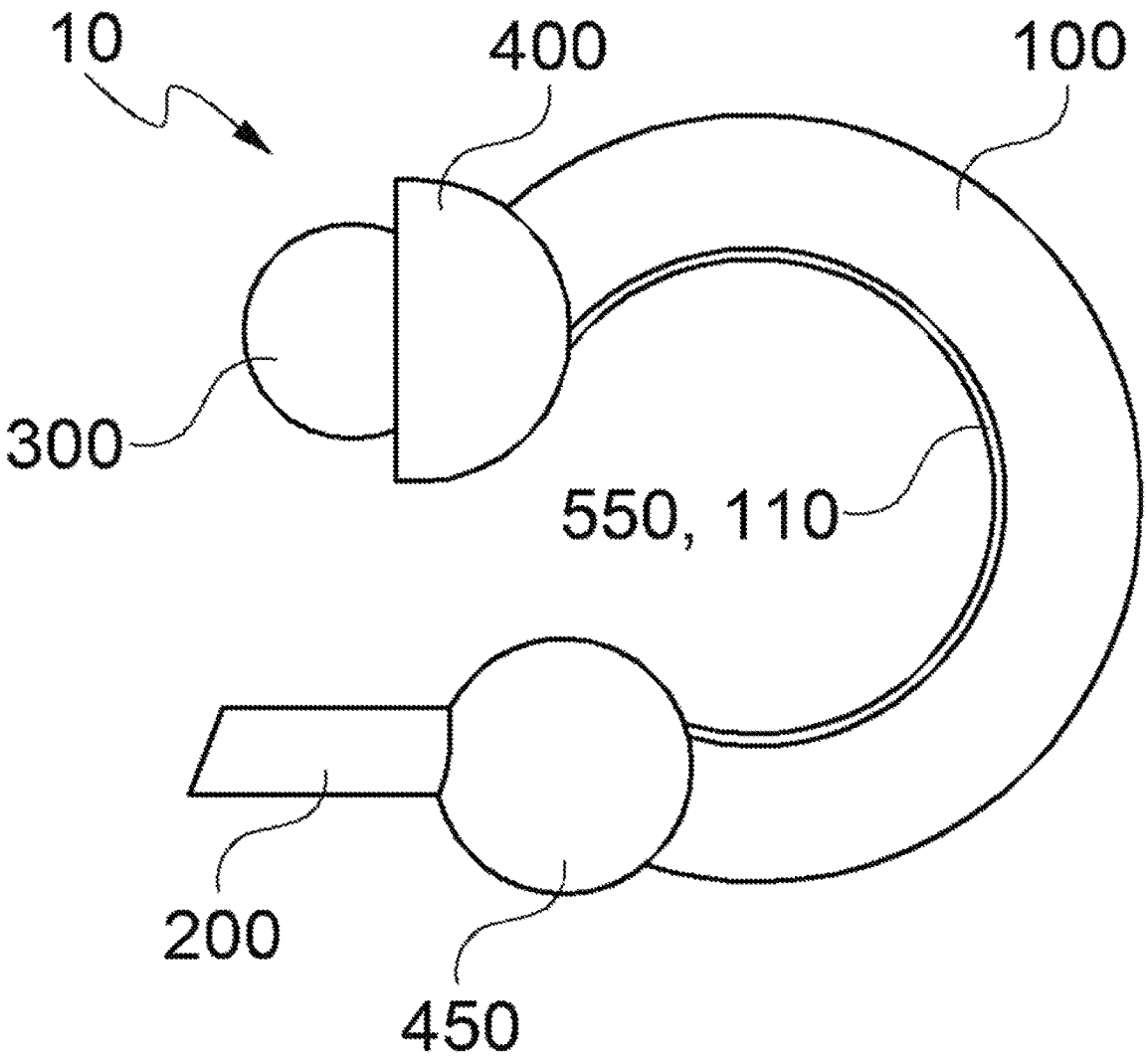
FIG. 1 illustrates a schematic view of an ear-mounted sound-output device in accordance with a first embodiment of the present disclosure.

Examples of various embodiments are illustrated in the accompanying drawings and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

Spatially relative terms, such as "beneath," "below," "lower," "under," "above," "upper," and the like, may be used herein for ease of explanation to describe one element or feature's relationship to another element s or feature s as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented for example, rotated 90 degrees or at other orientations, and the spatially relative descriptors used herein should be interpreted accordingly.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

As used herein, the term "substantially," "about," and similar terms are used as terms of approximation and not as terms of degree, and are intended to account for the inherent deviations in measured or calculated valves that would be recognized by those of ordinary skill in the art. Further, the use of "may" when describing embodiments of the present disclosure refers to "one or more embodiments of the present disclosure."

Hereinafter, various embodiments of the present disclosure will be described in details with reference to attached drawings.

Figure 2:
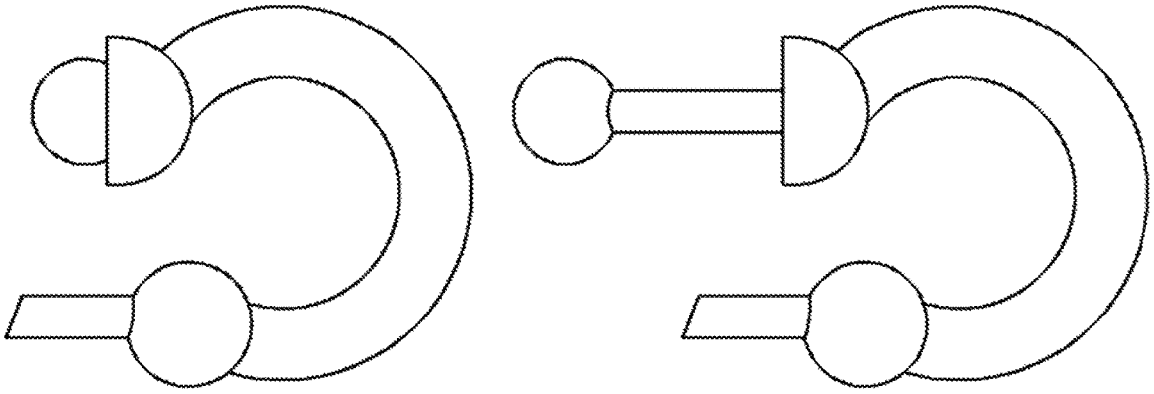
FIG. 2 illustrates a schematic view of FIG. 1 where a sound-output unit is extended outwardly.

FIG. 1 illustrates a schematic view of an ear-mounted sound-output device in accordance with a first embodiment of the present disclosure. FIG. 2 illustrates a schematic view of FIG. 1 where a sound-output unit is extended outwardly.

Figure 3:
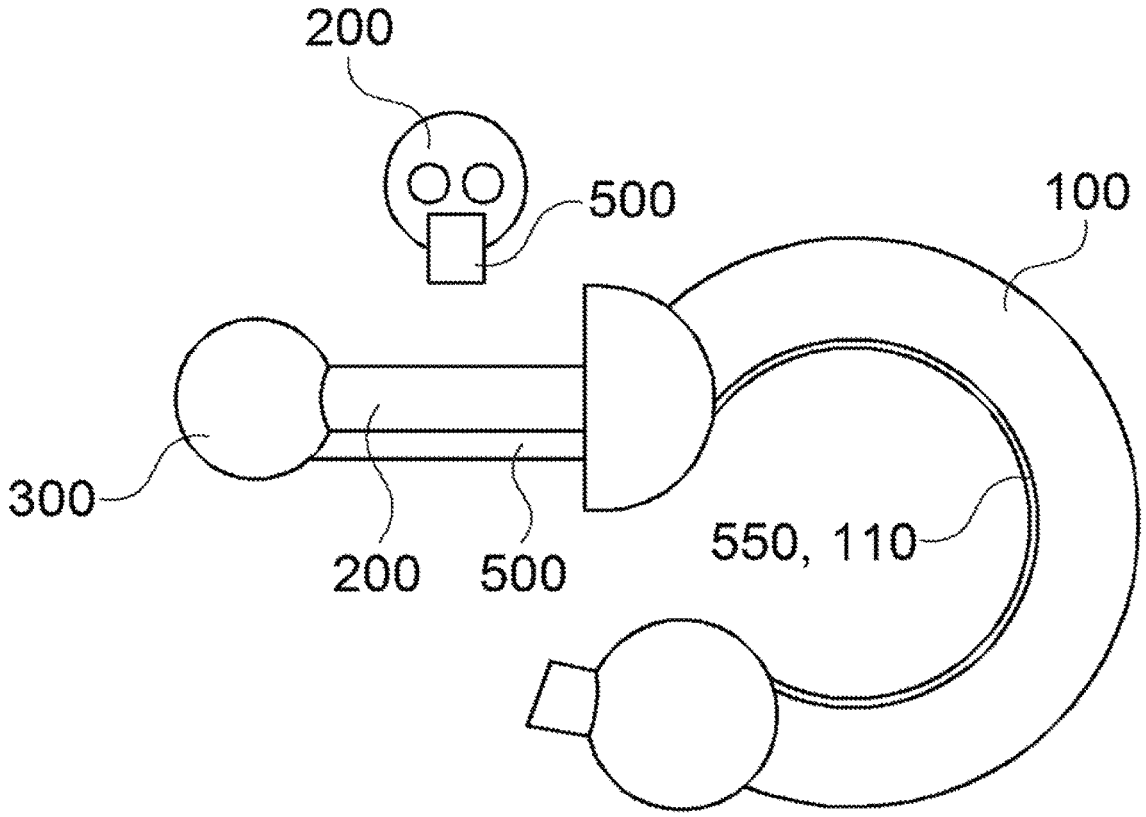
FIG. 3 illustrates a schematic view of FIG. 1 where a cable support is coupled to a cable.
Figure 4:
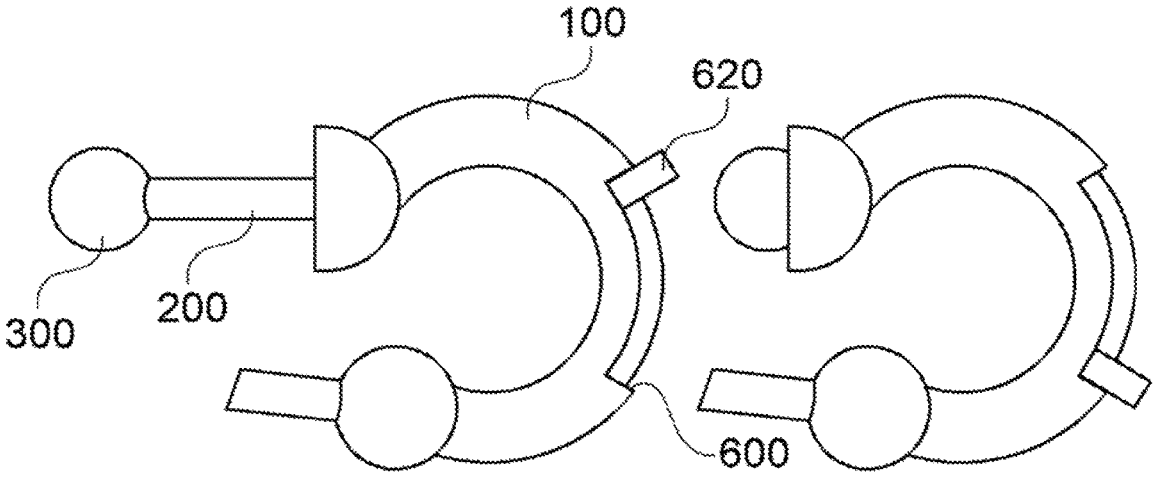
FIG. 4 illustrates a schematic view of FIG. 1 where a body cut portion is formed in a body and a cable moving member is coupled to a cable.

FIG. 3 illustrates a schematic view of FIG. 1 where a cable support is coupled to a cable. FIG. 4 illustrates a schematic view of FIG. 1 where a body cut portion is formed in a body and a cable moving member is coupled to a cable.

Figure 5:
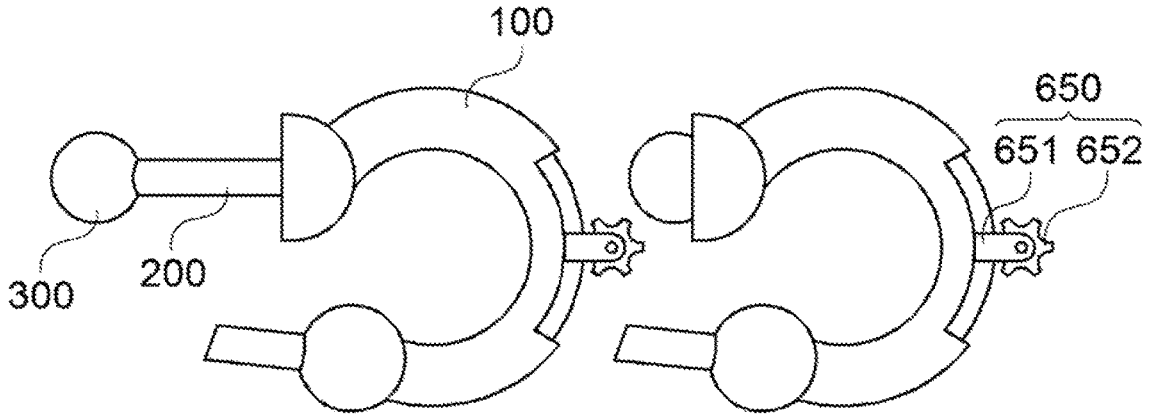
FIG. 5 illustrates a schematic view of FIG. 1 where a body cut portion is formed and a first cable moving member is coupled to a cable.
Figure 6:
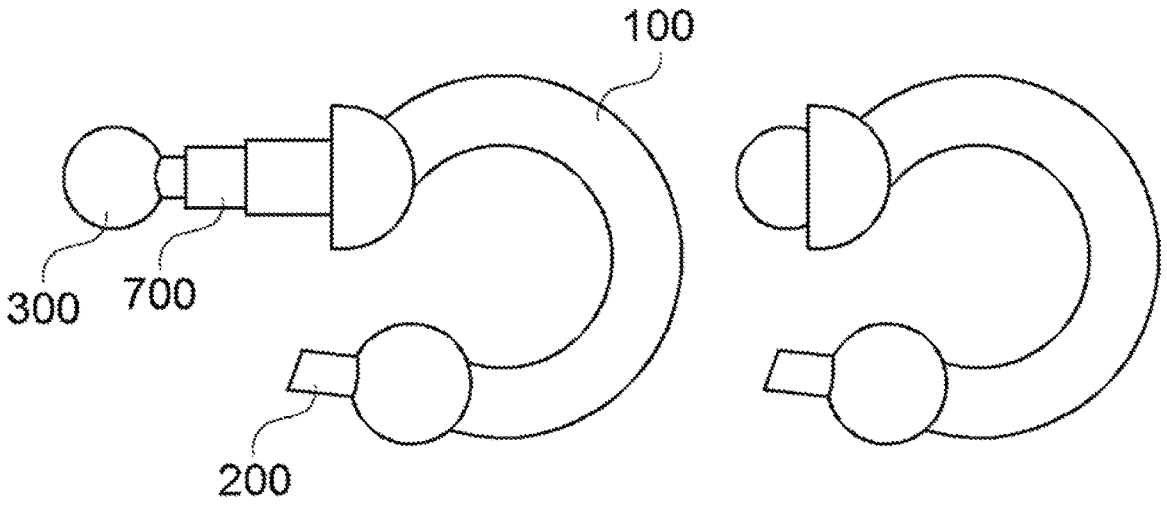
FIG. 6 illustrates a schematic view of FIG. 1 where a first sound-output unit support is coupled to a sound-output unit.

FIG. 5 illustrates a schematic view of FIG. 1 where a body cut portion is formed and a first cable moving member is coupled to a cable. FIG. 6 illustrates a schematic view of FIG. 1 where a first sound-output unit support is coupled to a sound-output unit.

Figure 7:
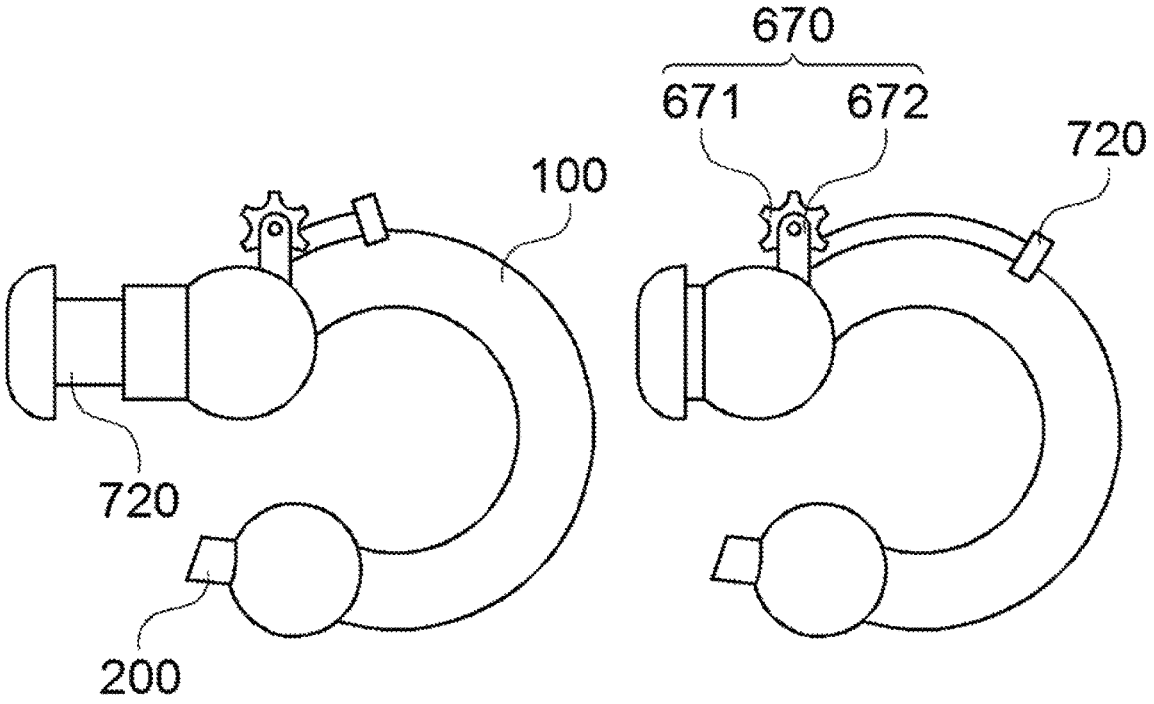
FIG. 7 illustrates a schematic view of FIG. 1 where a second sound-output unit support is coupled to a sound-output unit.
Figure 8:
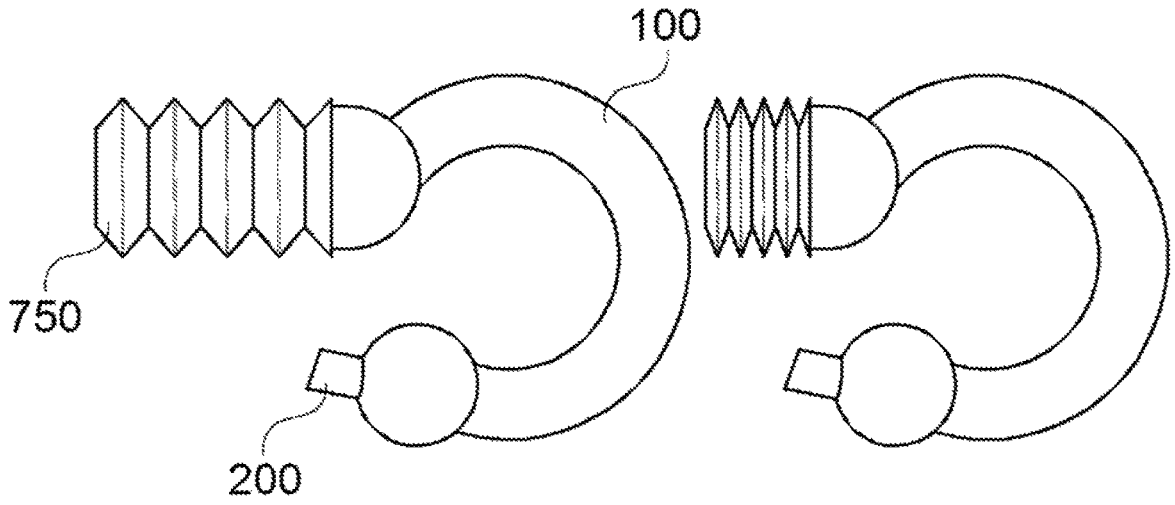
FIG. 8 illustrates a schematic view of FIG. 1 where a wrinkled length-adjustable tube is coupled to a sound-output unit.

FIG. 7 illustrates a schematic view of FIG. 1 where a second sound-output unit support is coupled to a sound-output unit. FIG. 8 illustrates a schematic view of FIG. 1 where a wrinkled length-adjustable tube is coupled to a sound-output unit.

Figure 9:
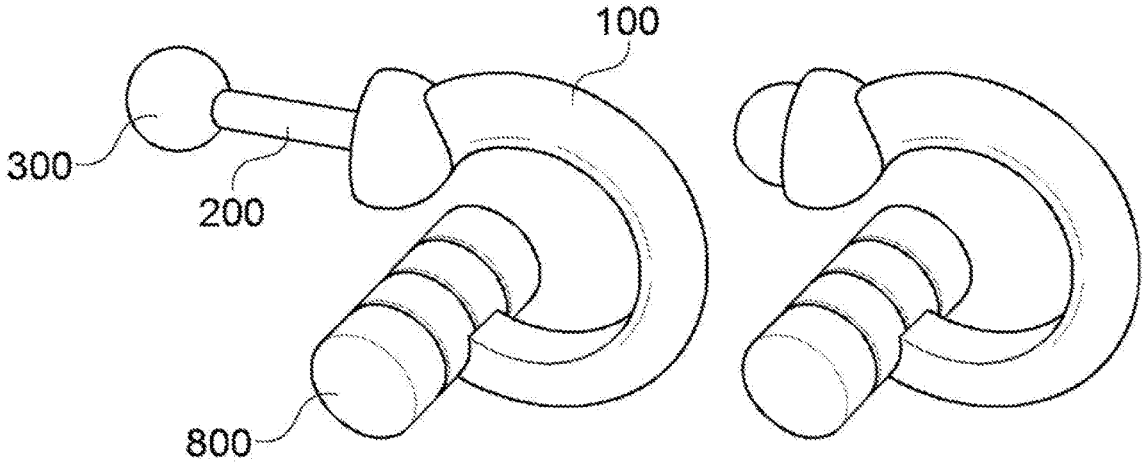
FIG. 9 illustrates a schematic view of an ear-mounted sound-output device in accordance with a second embodiment of the present disclosure.
Figure 10:
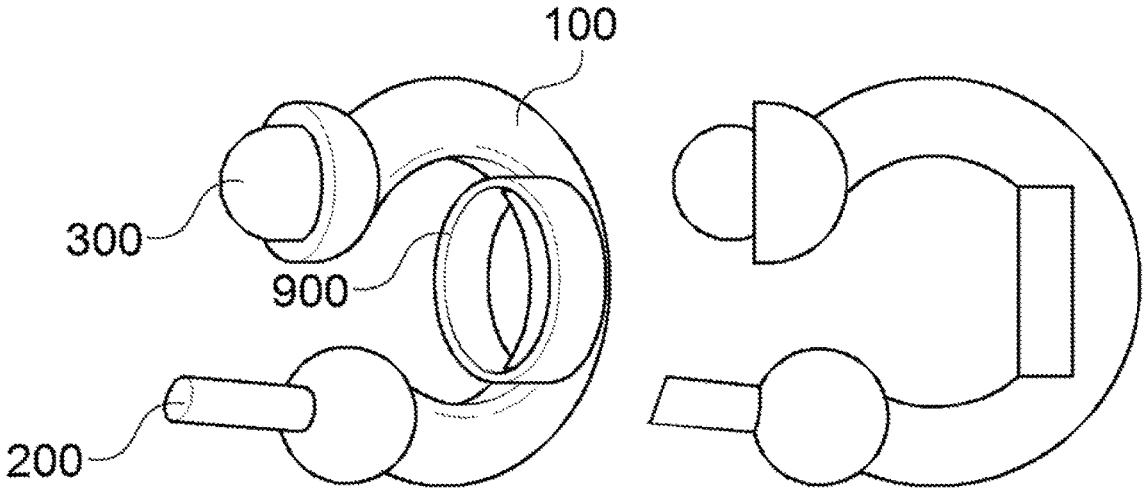
FIG. 10 illustrates a schematic view of FIG. 1 where a first loop-shaped deformation member is coupled to a body.
Figure 11:
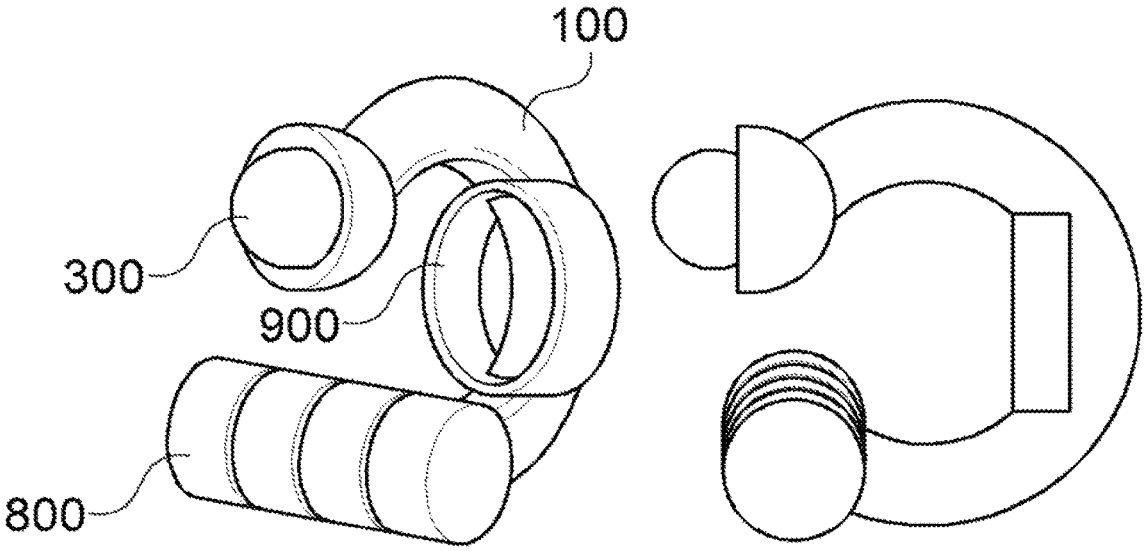
FIG. 11 illustrates a schematic view of FIG. 8 where a first loop-shaped deformation member is coupled to a body.

FIG. 9 illustrates a schematic view of an ear-mounted sound-output device in accordance with a second embodiment of the present disclosure. FIG. 10 illustrates a schematic view of FIG. 1 where a first loop-shaped deformation member is coupled to a body. FIG. 11 illustrates a schematic view of FIG. 8 where a first loop-shaped deformation member is coupled to a body.

Figure 12:
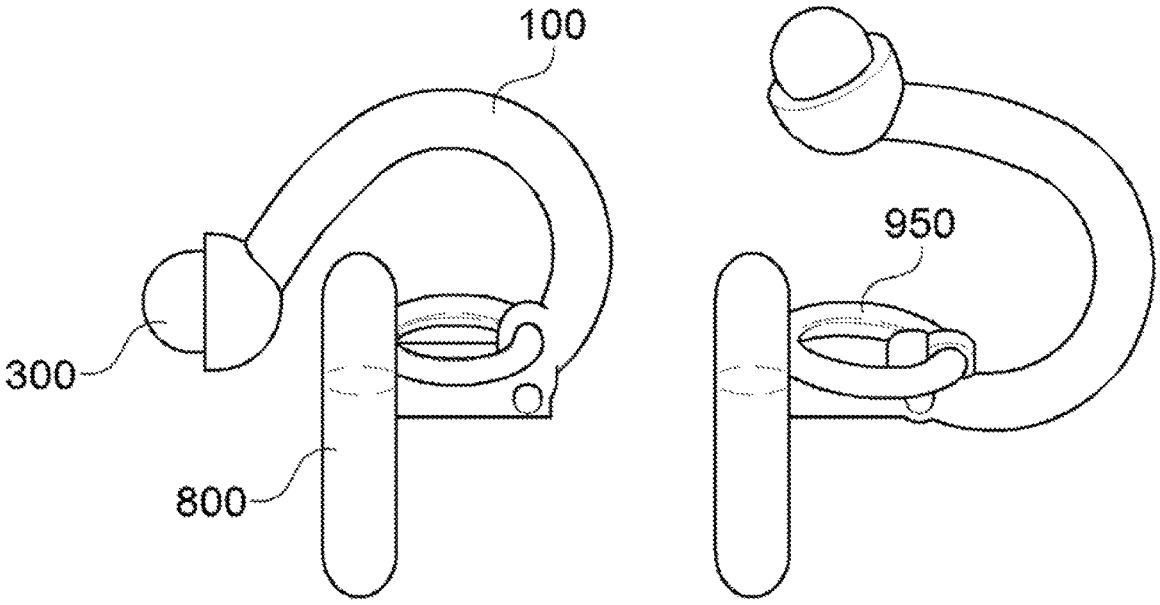
FIG. 12 illustrates a schematic view of an ear-mounted sound-output device in accordance with a third embodiment of the present disclosure.
Figure 13:
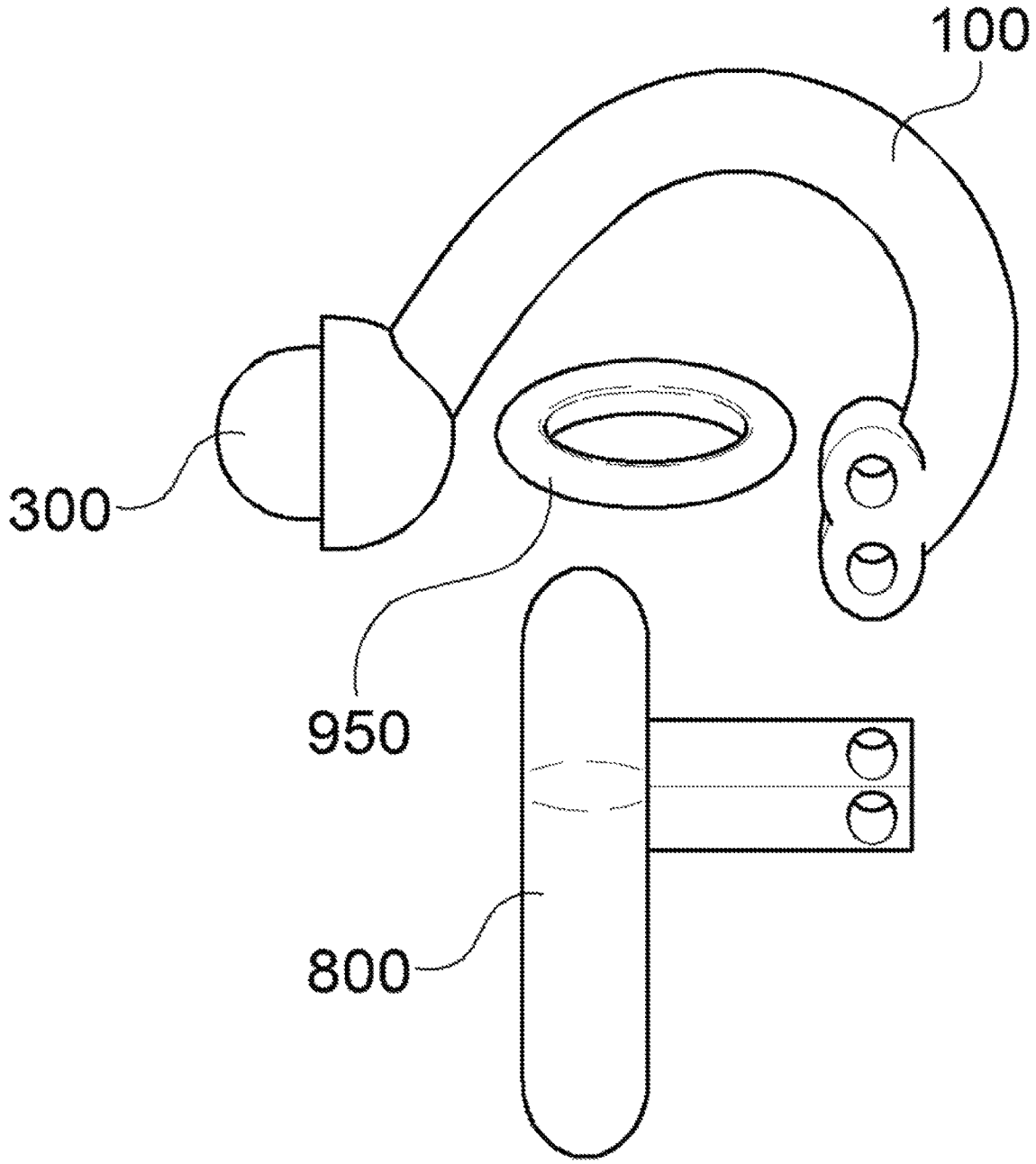
FIG. 13 illustrates a schematic exploded view of the ear-mounted sound-output device of FIG. 12.

FIG. 12 illustrates a schematic view of an ear-mounted sound-output device in accordance with a third embodiment of the present disclosure. FIG. 13 illustrates a schematic exploded view of the ear-mounted sound-output device of FIG. 12.

Figure 14:
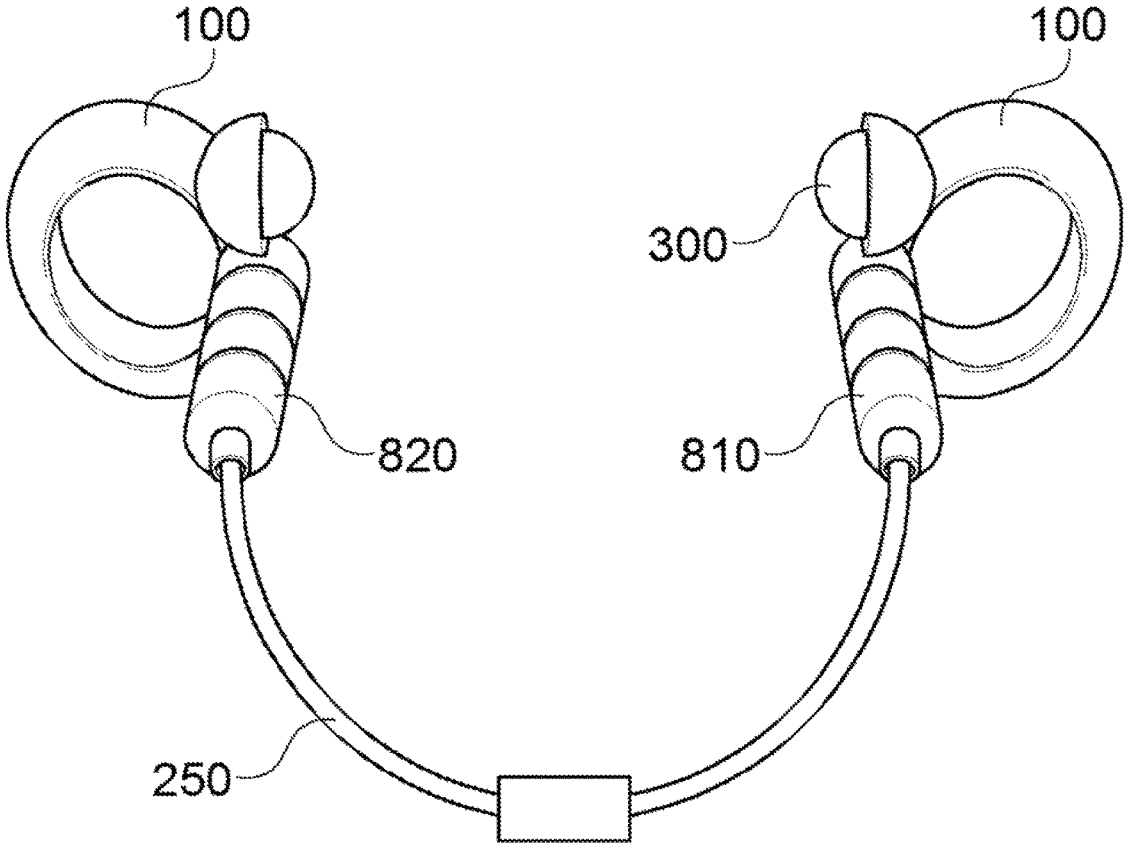
FIG. 14 illustrates a schematic view of an ear-mounted sound-output device in accordance with a fourth embodiment of the present disclosure.
Figure 15:
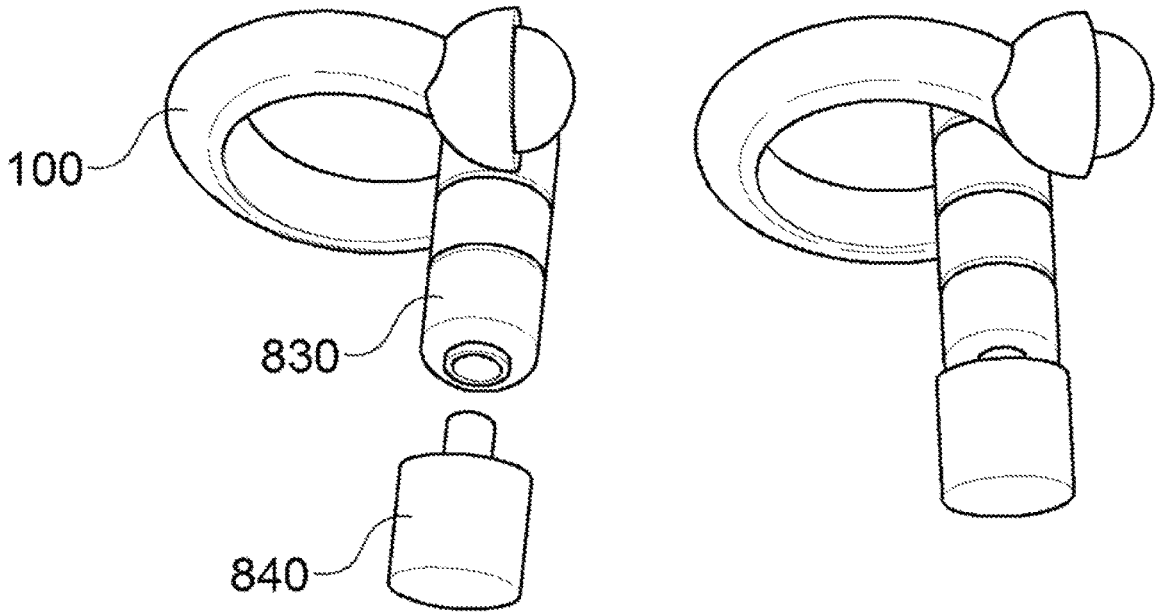
FIG. 15 illustrates a schematic view of FIG. 14 where an auxiliary battery is coupled to a main battery.

FIG. 14 illustrates a schematic view of an ear-mounted sound-output device in accordance with a fourth embodiment of the present disclosure. FIG. 15 illustrates a schematic view of FIG. 14 where an auxiliary battery is coupled to a main battery.

The embodiment of the present disclosure provides an ear-mounted sound-output device 10 with a position-adjustable sound-output unit, for example, a speaker. The ear-mounted sound-output device 10 may have a connection jack coupled to an audio player device such as a mobile phone, etc. The ear-mounted sound-output device 10 may include a 'C' shaped body 100 having an inner lengthwise hollow portion formed therein; a first connection cable 200 configured to extend through the inner lengthwise hollow portion of the body 100, and a sound-output unit 300 coupled to one end of the first connection cable 200, wherein the sound-output unit 300 may be configured to move to between an inner hole of an ear of a user and one end of the body 100 depending on an usage environment of the device, wherein the body 100 is stretched via application of an external force thereto, to allow the outer ear of the user to be inserted between both ends of the body, and the body 100 may be secured around the outer ear via withdrawal of the external force.

In this way, with the ear-mounted sound-output device 10, the sound-output unit 300 may be configured to move to between an inner hole of an ear of a user and one end of the body 100 depending on a usage environment of the device. Thus, the user may safely or reliably perform multiple tasks with hearing the music when the user needs to hear sounds related to the multiple tasks via a retracted state of the sound-output unit 300. Otherwise, the user may only listen to the music with blocking surrounding noises or sounds via an outwardly extended state of the sound-output unit 300. The former state refers to when the sound-output unit 300 is coupled to the body 100, while the latter state refers to when the sound-output unit 300 is inserted into the ear hole of the user.

The ear-mounted sound-output device, for example, an ear-phone device outputs a sound to an ear of the user. The ear-mounted sound-output device may be connected via a wire or wirelessly to, for example, a MP3 player, mobile phone, PC, notebook, tablet, etc.

The conventional ear-mounted sound-output device has a sound-output unit, for example, a kernel type-speaker, to be inserted into an ear hole of the user in use. Thus, in the use thereof, the user may only listen to the sound from the sound-output unit. However, most of the user may have a situation where the user has to perform multiple works including reading, exercises, or business at the same time as hearing the music. Thus, in such a situation, using the conventional ear-mounted sound-output device with the sound-output unit to be inserted into the ear hole, the user may rarely hear other sounds than the sound from the ear-mounted sound-output device. This may cause a dangerous event. For example, this may be applied to a situation when the user does outdoor activities such as jogging, bicycling, etc. Further, when the sound-output unit is inserted into the ear hole for a long time with continuously hearing the sound therefrom, a tympanic membrane of the user may be negatively affected.

From considerations of the above situations, the present disclosure provides an ear-mounted sound-output device with a position-adjustable sound-output unit configured to move to between an inner hole of an ear of a user and one end of the body depending on a usage environment of the device, whereby the user may safely or reliably perform multiple tasks with hearing the music when the user needs to hear sounds related to the multiple tasks via a retracted state of the sound-output unit, or, otherwise, the user may only listen to the music with blocking surrounding noises or sounds via an outwardly extended state of the sound-output unit.

The present sound-output unit may operate in a first mode where the sound-output unit is not inserted into the ear hole, but is secured to an outer face of the ear, whereby the user may hear both the sound from the ear-mounted sound-output device and the ambient sounds around the user, thereby to prevent the dangerous situation which, otherwise, may happen to the user. Further, the present sound-output unit may operate in a second mode where the sound-output unit is inserted into the ear hole, whereby the user may only hear the sound from the sound-output unit if desired by the user. Further, the ear-mounted sound-output device has both opposing stoppers at both ends of the body respectively, which may be engaged with the outer face of the ear at a spaced distance, to allow the ear-mounted sound-output device to be secured around the outer ear. Thus, when the user does outdoor activities with wearing the ear-mounted sound-output device, the present ear-mounted sound-output device may be prevented from being removed from the ear compared to the conventional ear-mounted sound-output device. Further, via the simple stretching or restoring operation of the body, the ear-mounted sound-output device may be disengaged or engaged from or with the ear.

The body 100 may be configured to enable the ear-mounted sound-output device 10 to be secured around the outer ear of the user. For this, the body 100 may be configured to be deformed via an external force. In one example, the body 100 may have a 'C' shaped form. The body 100 may have a size or form adapted to a size or form of the ear. The body 100 may have the lengthwise hollow portion to allow the first connection cable 200 to be received therein or move therethrough. The body 100 may be stretched via application of an external force thereto to allow the outer ear of the user to be inserted between both ends of the body, or, otherwise, the body 100 may be secured around the outer ear with the body being restored via withdrawal of the external force, In accordance with the embodiment of the present disclosure, the body may have an elasticity to allow the user to secure the ear-mounted sound-output device 10 to the ear of the user. Specifically, an elastic attachment 550 may be attached to one side of the body 100 wherein the elastic attachment 550 may be deformed via application of an external force and may be restored due to an elasticity force itself via withdrawal of the external force. Via application of an external force, the body 100 may be stretched to allow the outer ear of the user to be inserted between both ends of the body, and via withdrawal of the external force, the elastic attachment 550 may be restored due to an elasticity force itself to allow the body 100 to be secured around the outer ear of the user.

The elastic attachment 550 may have a restore force from the application of an external force to the body 100. Thus, when, via application of an external force, the body 100 may be stretched, the elastic attachment 550 may have a restore force therein. When via withdrawal of the external force, the elastic attachment 550 may be restored, the body 100 may be restored to its original shape, that is, the C shape. The elastic attachment 550 may be made of a variety of elastic members. One example thereof may be a leaf spring.

In accordance with the embodiment of the present disclosure, a body support 110 may be coupled to the body 100 to allow the user to easily secure the ear-mounted sound-output device 10 around the outer ear of the user. Specifically, the body support 110 may be coupled to and along a lengthwise portion of an outer or inner face of the body 100. The body support 110 may be deformed via application of a first external force to maintain the deformed body together therewith as they are deformed. When, via application of an external force, the body 100 may be stretched, the body support 110 may maintain the stretched body 100 in a shape thereof, to allow the outer ear of the user to be inserted between both ends of the body. Otherwise, the body support 110 may be restored to its original shape, namely, the C shape, via application of a second external force opposite the first external force, to maintain the restored body together therewith at they are restored, to allow the body 100 to be secured around the outer ear of the user.

The body support 110 may be deformed together with the body 100 to maintain the deformed body 110 as they are deformed. For this, as long as the body support 110 maintains the deformed body 110 together therewith as they are deformed, any type of materials may be possible. One example thereof may be an aluminum wire, or cooper wire, etc.

The body 100 may not be particularly limited in a material thereof as long as the body material meets a necessary strength.

The first connection cable 200 may be conventional in a conventional ear-mounted sound-output device, for example, an ear phone device. The first connection cable 200 may be electrically coupled to an audio player device such as a MP3 player, smartphone, etc. to transfer an audio signal from the audio player device to the sound-output unit 300 of the ear-mounted sound-output device 10. The first connection cable 200 may have one end passing through the hollow portion of the body 100 and coupled to the sound-output unit 300, and the other end coupled to the audio player device.

In accordance with the embodiment of the present disclosure, the ear-mounted sound-output device 10 may further include a cable support 500 coupled to one side of the first connection cable 200. The cable support 500 may move together with the movement of the first connection cable 200 to maintain a shape of the first connection cable 200. Based on the usage environment of the device 10, the first connection cable 200 may extend outwardly from the body. When the first connection cable 200 has extended outwardly from the body 110, the cable support 500 may maintain a certain shape of the first connection cable 200. The cable support 500 may not be particularly limited in a material thereof as long as the cable support material moves together with the movement of the first connection cable 200 to maintain a certain shape of the first connection cable 200. One example thereof may be an aluminum wire, or cooper wire, etc. The cable support 500 may be inserted into covering materials of the first connection cable 200.

The sound-output unit 300 may be conventional for a conventional ear-mounted sound-output device. The sound-output unit 300 may act to convert an electrical signal transferred from the first connection cable 200 to a sound signal. The sound-output unit 300 may be position-adjusted based on the usage environment of the device 10. That is, the usage environment may be divided into a first mode where the surrounding sounds around the user needs to be blocked, and into a second mode where the surrounding sounds around the user needs to be audible to the user. In the first mode, the sound-output unit 300 may be inserted into the ear hole of the user. In the second mode, the sound-output unit 300 may not be inserted into the ear hole of the user but be positioned adjacent to one end of the body 100.

In accordance with the embodiment of the present disclosure, the ear-mounted sound-output device 10 may further include a first stopper 400 coupled to one end of the body 100 and having an inner accommodation space formed therein to accommodate the sound-output unit 300, and the accommodation space being cable-communicating with the hollow portion of the body 100.

Based on the first and second modes, the first connection cable 200 may move through and along the hollow portion of the body 100 and the inner accommodation space of the first stopper 400. The first stopper 400 may act to protect the sound-output unit 300 from an external damage. The first stopper 400 may act to prevent the ear-mounted sound-output device 10 from being removed from the ear of the user. That is, the first stopper 400 may act as a protruding stopper to limit the movement of the body 100. The first stopper 400 may not be particularly limited in a configuration thereof as long as the configuration of the first stopper acts to protect the sound-output unit 300 from an external damage, and, at the same time, to prevent the ear-mounted sound-output device 10 from being removed from the ear of the user. For example, the first stopper 400 may be formed of a semi-sphere shaped hollow structure.

In accordance with the embodiment of the present disclosure, the ear-mounted sound-output device 10 may further include a second stopper 450 to prevent the ear-mounted sound-output device 10 from being removed from the ear of the user in cooperation with the first stopper 400. Specifically, in accordance with the embodiment of the present disclosure, the second stopper 450 may be coupled to the other end of the body 100 and may have a through-hole formed therein, the through-hole being cable-communicating with the hollow portion of the body 100. Based on the first and second usage modes of the device, the first connection cable 200 may move through and along the hollow portion of the body 100 and the through-hole of the second stopper 450. The second stopper 450 may act as a protruding stopper to limit the movement of the body 100. That is, a cooperation of the first and second stoppers 400 and 450 at both ends of the body 100 respectively may function to secure the body 100 around the outer ear of the user. The second stopper 450 may not be particularly limited in a configuration thereof as long as the configuration thereof acts to prevent the ear-mounted sound-output device 10 from being removed from the ear of the user. For example, the second stopper 450 may be formed of a sphere shaped structure with the through hole.

In accordance with the embodiment of the present disclosure, the body 100 may be partially removed to allow the movement of the first connection cable 200 to be free. Specifically, in accordance with the embodiment of the present disclosure, the body 100 may have a body cut portion 600 partially cut from the body 100 to partially expose the first connection cable 200. The user may push the first connection cable 200 through the body cut portion 600 and move the first connection cable 200, such that the sound-output unit 300 may move from one end of the body 100 into the ear hole of the user. A cut size or shape of the body cut portion 600 may not be particularly limited as long as the user may easily move the first connection cable 200 in and along the body 100.

In this connection, in one example, a cable moving member 620 may be coupled through the body cut portion 600 to the first connection cable 200. The user may grip and move the cable moving member 620 to correspondingly move the first connection cable 200. Specifically, the cable moving member 620 may have a bar shape. The cable moving member 620 may move between both ends of the body cut portion 600 to move the first connection cable 200 in and along the body 100, such that the sound-output unit 300 may move from one end of the body 100 into the ear hole of the user.

In one embodiment as shown in FIG. 5, the device 10 may further include a first cable moving member 650. The first cable moving member 650 may include a first connector 651 having one end coupled through the body cut portion 600 to the first connection cable 200, and a first rotation member 652 coupled to the other end of the first connector 651. The first rotation member 652 may have a circular shape and may have a teeth shaped circumference. When the first rotation member 652 is rotated by the user, the teeth shaped circumference thereof may contact and move the first connection cable 200, such that the sound-output unit 300 may move from one end of the body 100 into the ear hole of the user. The first connector 651 may have a bar shape. Further, the first connection cable 200 may have teeth-engaged grooves 210 formed in a lengthwise direction in an outer face portion thereof to be meshed with the teeth of the teeth shaped circumference of the first rotation member 652. In operation, when the first rotation member 652 is rotated by the user, the teeth-engaged grooves 210 are meshed with the teeth of the teeth shaped circumference of the first rotation member 652 and are moved in a lengthwise direction to move the first connection cable 200, such that the sound-output unit 300 may move from one end of the body 100 into the ear hole of the user.

In accordance with the embodiment of the present disclosure, the device 10 may include a first sound-output unit support 700. In the second mode where the sound-output unit is inserted into the ear hole, the first sound-output unit support 700 may be configured to prevent the sound-output unit 300 in an extended state from one end from the body 100 to be sagged. Specifically, the first sound-output unit support 700 may be implemented as length-adjustable multi-steps pipes or as extendable or retractable multi-steps pipes as shown in FIG. 6. The first sound-output unit support 700 may have one end coupled to the first stopper 400, and the other end coupled to the sound-output unit 300. The first sound-output unit support 700 may have a longitudinal through hole being cable-communicating with a through-hole of the first stopper 400 cable-communicating with the hollow portion of the body 100. In the second mode where the sound-output unit is inserted into the ear hole, the first sound-output unit support 700 may extend outwardly such that the first connection cable 200 may move through the longitudinal through hole of the support 700, the through-hole of the first stopper 400 and the hollow portion of the body 100.

In accordance with the embodiment of the present disclosure, the device 10 may further include a second sound-output unit support 720. The second sound-output unit support 720 may allow the first mode and second mode to be switched without extending the sound-output unit 300 from one end of the body. Specifically, the second sound-output unit support 720 may be implemented as length-adjustable multi-steps pipes or as extendable or retractable multi-steps pipes as shown in FIG. 7. However, in this case, the cable 200 may pass through the hollow portion of the second sound-output unit support 720. Rather, the sound-output unit 300 may be fixed to the first stopper 400. Thus, the sound from the sound-output unit 300 may be delivered through the hollow portion of the second sound-output unit support 720. In the second mode, the second sound-output unit support 720 may be extended outwardly such that the free end of the second sound-output unit support 720 may contact the ear hole of the user. Further, the second sound-output unit support 720 may have a body-side flexible member coupled to one end of the multi-steps pipes. The body-side flexible member may be configured to allow the extending of the multi-steps pipes to be facilitated as described below.

In accordance with the embodiment of the present disclosure, the device 10 may further include a support moving member 670 as shown in FIG. 7. This support moving member 670 may be configured to allow the extending of the second sound-output unit support 720 to be facilitated. This support moving member 670 may be disposed on one end of the body 100. Specifically, the support moving member 670 may include a second connector 672 having one end coupled to one end of the body 100, and a second rotation member 671 coupled to the other end of the second connector 672. The second rotation member 671 may have a circular shape and may have a teeth shaped circumference. When the second rotation member 672 is rotated by the user, the teeth of the teeth shaped circumference contact the body-side flexible member of the second sound-output unit support 720 and move the body-side flexible member to extend or retract the multi-steps pipe of the second sound-output unit support 720. Thus, depending on the first and second mode, the free end of the second sound-output unit support 720 may be inserted into the ear hole of the user or may be removed from the ear hole. The second connector 672 may have a bar shape.

In accordance with the embodiment of the present disclosure, the device 10 may further include a wrinkled length-adjustable tube 750 as shown in FIG. 8. The wrinkled length-adjustable tube 750 may allow the first mode and second mode to be switched without extending the sound-output unit 300 from one end of the body. Specifically, the wrinkled length-adjustable tube 750 may have one end coupled to the first stopper 400. The sound-output unit 300 may be fixed to the first stopper 400, or may be fixed to a non-free end of the wrinkled length-adjustable tube 750. The sound from the sound-output unit 300 may be delivered through the hollow portion of the wrinkled length-adjustable tube 750. In the second mode where the sound-output unit is inserted into the ear hole, the wrinkled length-adjustable tube 750 may be extended outwardly such that the free end thereof may contact the ear hole of the user. In operation, the user may grip and move the free end of the wrinkled length-adjustable tube 750 to open or block the ear hole of the user. The wrinkled length-adjustable tube 750 may be made of a material to allow the length-adjustable property thereof.

In accordance with the embodiment of the present disclosure, an ear-mounted sound-output device 10 may have an audio signal generation module 800 coupled to the body 100. Specifically, the audio signal generation module 800 may act to generate an audio signal to be delivered to the sound-output unit 300, for example, a speaker. The audio signal generation module 800 may be coupled to the opposite end to the end to which the sound-output unit 300 is disposed. The audio signal generation module 800 may act as the second stopper in the first embodiment, to limit the movement of the body 100 in cooperation with the first stopper to secure the body around the outer ear of the user. The first connection cable 200 may have the other end coupled to the audio signal generation module 800. Depending on the first and second usage mode of device, the first connection cable 200 may move through and along the hollow portion of the body 100. The audio signal generation module 800 may be installed to the body 100 in a variety of ways. In one example, the audio signal generation module 800 may have an elongate protrusion coupled via a hinge to the other end of the body 100. Via application of an external force, the body 100 may rotate using the hinge. In this connection, the device 10 may further include a second loop-shaped deformation member 950 as shown in FIG. 12. The second loop-shaped deformation member 950 may be deformed via application of an external force and may be restored due to the elasticity thereof via withdrawal of the external force. The second loop-shaped deformation member 950 may be coupled, at one side thereof, to the other end of the body 100, and, at the other side thereof, to one side face of the audio signal generation module 800. When the external force is applied to a middle point between the both sides of the deformation member 950 coupled to the body 100 and module 800 respectively, the second loop-shaped deformation member 950 may be deformed to enable the body 100 to rotate using the hinge. The deformation of the member 950 may increase a space between the free end of the body 100 and the audio signal generation module 800.

When the external force is applied to a middle point between the both sides of the deformation member 950 coupled to the body 100 and module 800 respectively, the second loop-shaped deformation member 950 may be deformed to increase a space between the free end of the body 100 and the audio signal generation module 800, such that the ear-mounted sound-output device 10 may be easily removed from the ear of the user. Otherwise, via the withdrawal of the force, the second loop-shaped deformation member 950 may be restored to decrease a space between the free end the body 100 and the audio signal generation module 800, such that the ear-mounted sound-output device 10 may be easily secured around the outer ear of the user.

The second loop-shaped deformation member 950 may not be particularly limited in a material thereof as long as the deformation and restoring may be realized via application and withdrawal of an external force respectively. One example thereof may be made of an elastic rubber or plastic. Preferably, the material of the second loop-shaped deformation member 950 may be polypropylene (PP) or polyurethane (PU).

The audio signal generation module 800 may be configured to generate an audio signal, and may be coupled to the other end of the body 100. The audio signal generation module 800 may act as a further stopper in addition to the first stopper to allow the body 100 to be secured around the outer ear of the user.

In accordance with the embodiment of the present disclosure, the body 100 may have an elasticity to allow the user to secure the ear-mounted sound-output device 10 around the outer ear of the user. Specifically, the device 10 may further include a first loop-shaped deformation member 900 configured to be deformed via application of an external force and be restored due to its elasticity via withdrawal of the force. The first loop-shaped deformation member 900 may be coupled to an inner side face of the C shaped body 100. When the force is applied to the first loop-shaped deformation member 900 at the lateral convex portions thereof, the first loop-shaped deformation member 900 may be deformed to allow the body 100 to be stretched.

When the external force is applied to the first loop-shaped deformation member 900 at the lateral convex portions thereof, the first loop-shaped deformation member 900 may be deformed to increase a space between the free end of the body 100 and the audio signal generation module 800, such that the ear-mounted sound-output device 10 may be easily removed from the ear of the user. Otherwise, via the withdrawal of the force, the first loop-shaped deformation member 900 may be restored to decrease a space between the free end of the body 100 and the audio signal generation module 800, such that the ear-mounted sound-output device 10 may be easily secured around the outer ear of the user.

The first loop-shaped deformation member 900 may not be particularly limited in a material thereof as long as the deformation and restoring may be realized via application and withdrawal of an external force respectively. One example thereof may be made of an elastic rubber or plastic. Preferably, the material of the first loop-shaped deformation member 900 may be polypropylene (PP) or polyurethane (PU).

In accordance with the embodiment of the present disclosure, an ear-mounted sound-output device as shown in FIG. 14 and FIG. 15 may further include a battery. To be specific, the signal generation module may be coupled to a one body 100, and a main battery may be coupled to the other body 100 as shown in FIG. 14. Specifically, the ear-mounted sound-output device may have an audio signal generation module 810 coupled to the other end of a first body 100, a audio signal output module 820 coupled to the first signal generation module 810 via a second connection cable 250 and coupled to a second body 100, and the second connection cable 250 configured to connect the audio signal generation module 810 and the audio signal output module 820 to each other. The signal generation module 810 may first generate an audio signal to deliver the signal output module 820. In alternative, the signal output module 820 may be replaced with a main battery 830 as shown in FIG. 15. The main battery 830 may supply electric energy to the signal generation module 810 and the signal output module 820. The signal output module 820 may be attached or detached to or from the second body 100. An auxiliary battery 840 may be attached or detached to or from the main battery 830 to charge the main battery 830. The second connection cable 250 may be configured to deliver the audio signal from the first signal generation module 810 to the signal output module 820. The second connection cable 250 may be configured to deliver electric energy from the main battery to the signal generation module 810. In an alternative, the main battery 830 may be coupled to one side of the signal output module 820.

The above description is not to be taken in a limiting sense, but is made merely for the purpose of describing the general principles of exemplary embodiments, and many additional embodiments of this disclosure are possible. It is understood that no limitation of the scope of the disclosure is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

REFERENCE NUMERALS

| | |
|---|---|
| 10: ear-mounted sound-output device | |
| 100: body | 110: body support |
| 200: first connection cable | 210: teeth-engaged grooves |
| 250: second connection cable | |
| 300: sound-output unit | |
| 400: first stopper | 450: second stopper |
| 500: cable support | 550: elastic attachment |
| 600: body cut portion | 620: cable moving member |
| 650: first cable moving member | |
| 651: first connector | 652: first rotation member |
| 670: support moving member | |
| 671: second connector | 672: second rotation member |
| 700: first sound-output unit support | |
| 720: second sound-output unit support | |
| 750: wrinkled length-adjustable tube | |
| 800: audio signal generation module | |
| 810: audio signal generation module | |
| 820: audio signal output module | |
| 830: main battery | 840: auxiliary battery |
| 900: first loop-shaped deformation member | |
| 950: second loop-shaped deformation member | |

What is claimed is:

1. An ear-mounted sound-output device with a position-adjustable sound-output unit, wherein the ear-mounted sound-output device comprises:

a 'C' shaped body having an inner lengthwise hollow portion formed therein;

a first connection cable configured to extend through the inner lengthwise hollow portion of the body;

a sound-output unit coupled to one end of the first connection cable, wherein the sound-output unit is configured to move to between an inner hole of an ear of a user and one end of the body depending on a usage environment of the device;

a first stopper coupled to one end of the body; and a first cable moving member, wherein the body has a body cut portion partially cut from the body to partially expose the first connection cable, wherein the first connection cable is configured to be moved through the body cut portion such that the sound-output unit moves from one end of the body into the ear hole of the user, wherein the first cable moving member includes a first connector having one end coupled through the body cut portion to the first connection cable, and a first rotation member coupled to the other end of the first connector, wherein the first rotation member has a circular shape and has a teeth shaped circumference, wherein when the first rotation member is rotated, the teeth shaped circumference thereof contacts and moves the first connection cable, such that the sound-output unit moves from one end of the body into the ear hole of the user, wherein the body is stretched via application of an external force thereto to allow an outer ear of the user to be inserted between both ends of the body, and the body is secured around the outer ear with the body being restored via withdrawal of the external force, wherein the first connection cable is configured to move through the hollow portion depending on the usage environment of the device.

2. The device of claim 1, wherein the device further comprises a second stopper coupled to the other end of the body, wherein a cooperation of the first and second stoppers at both ends of the body respectively allows the body to be secured around the outer ear of the user, wherein, depending on the usage environment of the device, the first connection cable is configured to move through and along the hollow portion of the body.

3. The device of claim 1, wherein the device further comprises a cable support coupled to the first connection cable in a longitudinal manner, the cable support being configured to move together with the movement of the first connection cable to maintain a shape of the first connection cable resulting from the movement thereof.

4. The device of claim 1, wherein the first connection cable has teeth-engaged grooves formed in a lengthwise direction in an outer face portion thereof to be meshed with the teeth of the teeth shaped circumference of the first rotation member, wherein when the first rotation member is rotated, the teeth-engaged grooves are meshed with the teeth of the teeth shaped circumference of the first rotation member and are moved in a lengthwise direction to move the first connection cable, such that the sound-output unit moves from one end of the body into the ear hole of the user.

5. The device of claim 1, wherein the device further comprises a first sound-output unit support, wherein the first sound-output unit support includes extendable or retractable multi-steps pipes, and wherein the first sound-output unit support has one end coupled to the first stopper, and the other end coupled to the sound-output unit, wherein the first sound-output unit support has a longitudinal through hole being cable-communicating with a through-hole of the first stopper cable-communicating with the hollow portion of the body, wherein the first sound-output unit support extends outwardly such that the first connection cable moves through the longitudinal through hole of the support, the through-hole of the first stopper and the hollow portion of the body, such that the sound-output unit is inserted into the ear hole.

6. The device of claim 1, wherein the device further comprises a wrinkled length-adjustable tube has one end coupled to the first stopper, wherein the wrinkled length-adjustable tube is extended outwardly such that the free end thereof contacts the ear hole of the user.

7. The device of claim 1, wherein the device further comprises an elastic attachment attached to one side of the body, wherein the elastic attachment is configured to be deformed via application of an external force and be restored due to an elasticity force itself via withdrawal of the external force, wherein via application of an external force, the body is stretched to allow the body to be inserted into the ear of the user, and via withdrawal of the external force, the elastic attachment is restored due to an elasticity force itself to allow the body to be secured around the outer ear of the user.

8. The device of claim 1, wherein the device further comprises a first loop-shaped deformation member configured to be deformed via application of an external force and be restored due to its elasticity via withdrawal of the force, wherein the first loop-shaped deformation member is coupled to an inner side face of the C shaped body, wherein when the force is applied to the first loop-shaped deformation member at the lateral convex portions thereof, the first loop-shaped deformation member is deformed to allow the body to be stretched.

9. The device of claim 1, wherein the device further comprises a body support coupled to and along a lengthwise portion of an outer or inner face of the body, wherein the body support is deformed via application of a first external force to maintain the deformed body together therewith as they are deformed, wherein via application of the first external force, the body is stretched, the body support maintains the stretched body in a shape thereof, to allow the outer ear of the user to be inserted between both ends of the body, wherein via application of a second external force opposite the first external force, the body support is restored to its original shape to maintain the restored body together therewith at they are restored, to allow the body to be secured around the outer ear of the user.

10. An ear-mounted sound-output device with a position-adjustable sound-output unit, wherein the ear-mounted sound-output device comprises:

a 'C' shaped body having an inner lengthwise hollow portion formed therein;

a first connection cable configured to extend through the inner lengthwise hollow portion of the body;

a sound-output unit coupled to one end of the first connection cable, wherein the sound-output unit is configured to move to between an inner hole of an ear of a user and one end of the body depending on a usage environment of the device; and a first stopper coupled to one end of the body, wherein the body is stretched via application of an external force thereto to allow an outer ear of the user to be inserted between both ends of the body, and the body is secured around the outer ear with the body being restored via withdrawal of the external force, wherein the first connection cable is configured to move through the hollow portion depending on the usage environment of the device, wherein the device further comprises a first sound-output unit support including extendable or retractable multi-steps pipes, wherein the first sound-output unit support further has a body-side flexible member coupled through the first stopper to one end of the multi-steps pipes, wherein when a free end of the body-side flexible member moves toward the first stopper, the first sound-output unit support is extended outwardly such that a free end of the first sound-output unit support contacts the ear hole of the user.

11. The device of claim 10, wherein the device further comprises a support moving member, wherein the support moving member includes a first connector having one end coupled to one end of the body, and a first rotation member coupled to the other end of the first connector, wherein the first rotation member has a circular shape and has a teeth shaped circumference, wherein when the first rotation member is rotated, the teeth of the teeth shaped circumference contact the body-side flexible member of the first sound-output unit support and move the body-side flexible member so as to extend or retract the multi-steps pipe of the first sound-output unit support, such that the free end of the first sound-output unit support is inserted into the ear hole of the user or is removed from the ear hole.

12. An ear-mounted sound-output device with a position-adjustable sound-output unit, wherein the ear-mounted sound-output device comprises:

a 'C' shaped first body having an inner lengthwise hollow portion formed therein;

a first connection cable configured to extend through the inner lengthwise hollow portion of the body;

a sound-output unit coupled to one end of the first connection cable, wherein the sound-output unit is configured to move to between an inner hole of an ear of a user and one end of the body depending on a usage environment of the device;

an audio signal generation module coupled to the other end of the body;

a second "C" shaped body;

an audio signal output module coupled to the second body;

a second connection cable configured to connect the audio signal generation module and audio signal output module to each other; and a main battery disposed on one side of the audio signal output module, wherein the main battery is configured to supply electric energy to the audio signal generation module and audio signal output module, wherein the body is stretched via application of an external force thereto, to allow an outer ear of the user to be inserted between both ends of the body, and the body is secured around the outer ear with the body being restored via withdrawal of the external force, wherein the first connection cable is configured to move through the hollow portion depending on a usage environment of the device.

13. The device of claim 12, wherein the audio signal generation module has an elongate protrusion coupled via a hinge to the other end of the body, wherein via application of an external force, the body rotates using the hinge, wherein the device further comprises a loop-shaped deformation member configured to be deformed via application of an external force and be restored due to the elasticity thereof via withdrawal of the external force, wherein the loop-shaped deformation member is coupled, at one side thereof, to the other end of the body, and, at the other side thereof, to one side face of the audio signal generation module, wherein when the external force is applied to both convex side portions of the deformation member, the loop-shaped deformation member is deformed to enable the body to rotate using the hinge, such that the deformation of the loop-shaped deformation member increases a space between the free end of the body and the audio signal generation module.

14. The device of claim 12, wherein each of the audio signal generation module and audio signal output module is attached or detached to or from the device using the second cable.

15. The device of claim 12, wherein the device further comprises an auxiliary battery configured to be attached or detached to or from the main battery to charge the main battery.

16. The device of claim 12, wherein the device further includes a first stopper coupled to one end of the body and having an inner accommodation space formed therein to accommodate the sound-output unit.

* * * * *